US006372094B1

(12) United States Patent
Heikkilä et al.

(10) Patent No.: US 6,372,094 B1
(45) Date of Patent: Apr. 16, 2002

(54) PULP DRYING LINE AND METHOD FOR DRYING PULP

(75) Inventors: Pertti Heikkilä , Raisio; Paavo Sairanen, Turku, both of (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/673,502

(22) PCT Filed: Apr. 28, 1999

(86) PCT No.: PCT/FI99/00344

§ 371 Date: Oct. 17, 2000

§ 102(e) Date: Oct. 17, 2000

(87) PCT Pub. No.: WO99/55957

PCT Pub. Date: Nov. 4, 1999

(30) Foreign Application Priority Data

Apr. 28, 1999 (FI) ..... 980928

(51) Int. Cl.[7] ..... D21F 9/00; D21F 11/00

(52) U.S. Cl. ..... 162/381; 162/201

(58) Field of Search ..... 162/9, 13, 18, 162/24, 25, 23, 28, 56, 109, 203, 204, 206, 207, 201, 381; 34/381, 382, 384, 387, 388, 623, 624, 629, 635, 636, 643, 647, 649, 651, 657

(56) References Cited

U.S. PATENT DOCUMENTS 3,634,948 A * 1/1972 Kobayashi ..... 34/643
4,112,587 A * 9/1978 Sundman ..... 34/388
4,218,414 A * 8/1980 Hagg et al. ..... 264/40.4
4,462,868 A * 7/1984 Oubridge et al. ..... 162/280
6,014,818 A * 1/2000 Kristrom ..... 34/273

FOREIGN PATENT DOCUMENTS

| | | | |
|---|---|---|---|
| DE | 36 15 152 A1 | 11/1987 | ..... D21F/5/18 |
| DE | 3615152 A1 * | 12/1987 | ..... D21F/5/18 |
| DE | 3807 858 A1 | 9/1989 | ..... F26B/13/08 |
| FI | 731869 | 12/1974 | ..... D21F/5/18 |
| WO | WO 96/22419 | 7/1996 | |
| WO | WO 99/09246 | 2/1999 | ..... D21F/5/18 |

* cited by examiner

*Primary Examiner*—Peter Chin
*Assistant Examiner*—Eric Hug
(74) *Attorney, Agent, or Firm*—Nixon & Vanderhye P.C.

(57) ABSTRACT

A pulp drying line which comprises a pulp press for pre-drying the pulp and a defibrator for shredding the pre-dried pulp into a loose pulp. The drying line further comprises a web forming section and a pulp dryer section. The loose pulp coming from the defibrator is spread in the web forming section in a layer on an air-permeable forming base, from which the air-permeable pulp web thus formed is taken through the dryer section supported by an air-permeable support fabric, such as a wire. The pulp is not formed into a pulp web during pre-drying.

30 Claims, 4 Drawing Sheets

PULP DRYING LINE AND METHOD FOR DRYING PULP

CROSS-REFERENCE TO RELATED APPLICATION

This application is a U.S. national phase of International application PCT/F199/00344 filed Apr. 28, 1999.

BACKGROUND AND SUMMARY OF THE INVENTION

The object of the present invention is a pulp drying line and a method for drying pulp, as defined in the preambles of the independent claims presented below.

It is previously known to dry chemical pulp by means of drying cylinders, in which case a conventional web with a dry matter content of 45–50% is formed from the pulp coming from the headbox on the wire and press section, the said web being finally dried to the desired dryness on the cylinder dryer section. It is, however, difficult to break up this pulp again in connection with paper manufacture.

To remedy the problem, it is proposed in Finnish patent number 58020 that the pulp web coming from the wire and press section be dried to a dry matter content of only approximately 60–70% in the conventional manner with cylinders, after which the actual final drying is proposed to be carried out by means of hot gas blown through the pulp. This means that the conventional pre-dried pulp web coming from the cylinders will have to be shredded and defibrated to form a loose pulp which allows through-blowing. Of the loose pulp thus obtained a porous air-permeable pulp web is formed between two horizontal wires, and the said web is finally dried. Shredding and defibration of the viscous pre-dried pulp web into a fine loose pulp is not, however, always easy.

In the case of FI 58020, final drying takes place gradually, so that in the first part of the dryer section hot gas is blown through the pulp web from the blow box above the web to the suction box below the web, from where the exhaust air is conducted, via a heater, to the blow box adjacent to the suction box below the web and second in order, from which air is blown further up through the web to the suction box second in order above the web. From the second suction box the air is blown further in a corresponding manner through a third pair of blow/suction boxes, etc. At the end of the dryer section, the exhaust air is taken from the last suction box back to the beginning of the dryer section through an air duct having a length corresponding to the entire dryer section. In this case, therefore, the air circulation is very long, since the entire drying air flow passes first in a wave-like fashion through the long dryer section and then finally back to the beginning of the dryer section. Any changes in the air flow at the beginning of the air circulation will affect air flow throughout the entire dryer section. The system does not allow for local adjustment of air blowing.

The pulp drying solution described above, in which pre-drying is carried out by means of drying cylinders and final drying in a horizontal dryer section, requires a conventional web to be formed of the pulp at two separate times—first, before cylinder drying, and second, before fan drying. The drying line with its cylinders and horizontal final dryer section is long and thus takes up a lot of space.

The aim of the present invention is to achieve an improved drying line and method for drying pulp.

A particular aim in this case is to achieve a drying line construction which takes up less space and is more economical as regards its construction costs.

A further aim is to achieve a method by means of which still relatively moist pulp coming from the pulp press can be dried efficiently without conventional pre-drying by means of drying cylinders.

To achieve the above aims, the method, apparatus and chemical pulp drying line relating to the invention are characterised by what is defined in the characterising part of the independent claims presented below.

A typical pulp drying line relating to the invention for drying chemical pulp with a dry matter content of less than 3% comprises a pulp press, a defibrator, a web forming section and the actual dryer section. The pulp press used may, for example, be a roll press in which the pulp is pressed in a nip between two rolls to a dry matter content of about 30–50%, typically 40–50%. From the pulp press the pulp is taken, for example, by means of a screw conveyor, to the defibrator. According to a preferred solution of the invention, the pulp is taken directly from the press to the defibrator without being formed into a web in the meantime, which thus saves the cost of web forming at this stage. The pulp can be conveyed by means of the screw conveyor, which means that the pulp can also be dewatered at this stage.

The pulp pre-dried in the defibrator is defibrated to form a loose pulp suitable for web formation. The loose pulp is taken to the web forming section, where the pulp is formed into an air-permeable pulp web on a forward-running air-permeable forming base, typically a wire. The loose pulp flakes and/or fibres are spread by spreading means on the forming base, to form an air-permeable layer.

In the actual dryer section, which comprises a forward-running air-permeable support fabric, such as a wire, which supports the pulp web as it passes through the dryer section, and blowing means or the like, by means of which drying air or gas is blown through the pulp web in order to dry it.

A typical chemical pulp drying line relating to the invention comprises, in the actual dryer section,

- blow boxes, through-blowing cylinders such as drying drums, or other similar means for blowing drying air through the pulp web to be dried, and
- suction boxes, suction cylinders or air-removal means for removing the air that has passed through the pulp web and absorbed moisture into it from the vicinity of the pulp web.

In a first solution relating to the invention, blow boxes and suction boxes are fitted in the dryer section to form narrow vertical drying gaps extending through the dryer section in cross-web direction. The gaps are only about 30–100 mm, preferably 50–70 mm, wide in the machine direction. The drying gaps are delimited on one side by blow boxes fitted across the machine, and on the other by one or more suction boxes extending across the machine.

The dryer section preferably incorporates several drying gaps in succession, in which case the pulp web to be dried is arranged to pass through the successive drying gaps alternately upwards and downwards. At the same time, hot drying air is blown from a blow box on the first side of the web to the opposite suction box on its other side. The drying air is supplied to the blow boxes from fan towers adjacent to the actual dryer section. A pressure difference of typically about 200–800 Pa is arranged across the pulp web, due to which the drying air flows through the web.

While passing through the web, the drying air cools down and becomes wet. From the suction box the cooled air containing moisture is taken to the heater in the fan tower, from where the air, once heated, is taken back to the blow box on the first side of the web. Some of the wet cooled air coming from the suction box is replaced by fresh dry air.

In this first solution relating to the invention, the drying air circulation has been arranged so as to be local, and is thus very short. Drying air circulation takes place by means of fan towers integrated into the dryer section. The fan towers supply drying air to the blow boxes from single vertical compressed air chambers connected to the ends of the blow boxes and situated adjacent to the machine. A compressed air chamber is preferably arranged to supply drying air to two separate blow box units fitted in succession in the machine direction and comprised of blow boxes placed on top of one another.

The fan towers collect the return air from the suction boxes into a return air chamber connected to the ends of the suction boxes and fitted adjacent to the dryer section, thus maintaining underpressure in the suction boxes. One return air chamber is preferably arranged to collect return air from two separate suction boxes fitted in succession in the machine direction.

In this first dryer section relating to the invention, several pressure chambers and vacuum return air chambers are typically arranged alternately and in succession on both sides of the machine. The pressure chambers and return air chambers on the different sides of the machine are fitted opposite each other in the dryer section, so that drying air is supplied to the drying gap from one side of the machine, while removing return air from the other side of the machine. At least some of the return air supplied to the return air chamber is recirculated via the heater back to the pressure chamber. From one fan tower, drying air is typically supplied to 3–5 drying gaps. In the solution relating to the invention separate long air ducts or air systems outside the dryer are not required, as the drying air circulation has been arranged so as to be local.

The travel of the pulp web is supported in this first solution relating to the invention usually by means of at least one wire as it passes through the vertical drying gaps between the blow and suction boxes. However, through the first drying gap or gaps the pulp web is preferably conveyed between two wires. If necessary, the pulp web can be conveyed through the entire dryer section supported by two wires. On the other hand, in some cases the pulp web may reach the necessary strength towards the end of the dryer section to be able to run without the support of the wire. Turning rolls or the like, by means of which the travel of the pulp web and the wire can be turned from one drying gap to the next, are arranged between the drying gaps, in the upper and lower parts of the dryer section. The turning rolls can also be utilised for the purpose of drying by providing them with suitable suction or blowing. Vacuum rolls at the same time ensure the travel of the pulp web.

In the drying line relating to the invention, in front of or at the start of its actual dryer section, a horizontal web forming section is typically arranged, in which web forming section a pulp web is formed of the loose pulp by spreading the pulp on a horizontal air-permeable forming base, such as a wire, or by feeding pulp into the gap between two wires. In the horizontal section, blow boxes blowing drying air may be fitted above or below the pulp web supported by two wires, and on the other side of the web, opposite the blow boxes, may be fitted a suction box or boxes for removing the air blown through the web as exhaust air from the web. In the horizontal section, the pulp web is pre-dried to a dry matter content of, for example, about 55–65%.

After the horizontal run, the web is guided preferably first downwards between two wires, to the lower part of the dryer section, and from there on, turned by the turning roll, to the lower end of the first long drying gap, that is, a drying gap of full height. From there the pulp web can be conveyed upwards, supported by one or two wires, in the drying gap delimited by a blow box or boxes and a suction box or boxes. If only one conveying or support wire is used, this is fitted to run between the suction box and the pulp web, which means that it will prevent the web from being sucked into contact with the suction box. In the upper part of the drying gap, the wire conveys the pulp web over the second turning roll to the next drying gap in the direction of the web, in which gap the pulp web travels downwards.

In this first drying line relating to the invention, the pulp web is typically made to pass through >10, e.g. about 20–30, vertical drying gaps, supported first by two wires and later by only one wire.

In an alternative second drying solution relating to the invention the air-permeable pulp web may be dried by means of drying drums in which are fitted means for blowing or sucking drying air through the pulp web passing over the drum shell. The drum is preferably of light-weight construction. Its outermost shell may be made, for example, of strong netting or perforated plate, which allows air to be blown or sucked through the shell. That part of the drum which is not covered by the pulp web may be sealed either from the inside or the outside of the drum, if desired. In some cases the drum shell may even be left unsealed. The drying drums may be drawn by the wire, in which case they will not require driving units for to effect traction.

The drying drums may be fitted on top of one another in vertical "stacks", as has been done with cylinder dryers. On the other hand, drying drums may be fitted in succession, in the same way as drying cylinders in a conventional paper machine dryer section.

All drying drums may be through-blowing drums, that is, provided with means which blow drying air through the pulp web passing over the drum shell. In this case the pulp web, which typically passes between two wires, is arranged to run alternately with the first and second side towards the drying drum, which means that the direction of flow of the drying air through the pulp web changes each time when changing from one roll to the next. If so desired, at least some of the drying drums may be equipped with means for effecting suction, which means that air is sucked through the pulp web towards the drum.

When the drying drums act as blowing drums, the drying air that has flowed through the pulp web may be released freely into the area surrounding the drying drums. The drying drums are preferably surrounded by a hood, so that the used drying air can be recovered, heated and re-used for drying. Air is supplied to the drying drums preferably on the driving side, at the ends of the drums. Some air is removed from the hood as exhaust air and replaced by the required amount of replacement air.

If necessary, a pulp web pre-dried in the conventional manner, by pressing in web form, can be dried further according to the methods described above, provided that the permeability of the pulp web is increased before drying by forming apertures in the web to create pores. By means of the perforation it is ensured that the heat transfer area between the drying air and the pulp is sufficiently large. The heat transfer surface should preferably cool the temperature of the drying air close to the temperature of the pulp web to be dried during the through-flow. The perforation makes it possible to dry a pulp web with a higher than usual grammage. The grammage of a chemical pulp web may, for example, be 600–4000 g/m2, most preferably 1000–3000 g/m2.

The perforation percentage, that is, the open surface area, may be 2–20%, most preferably 5–15%. The diameter of the holes is typically 0.3–8 mm, most preferably 0.5–4 mm, preferably 1–3 mm. The distance between holes is 1–10 mm, most preferably 2–5 mm. Perforation is preferably carried out in a roll nip, the said nip being formed between two rolls, one of which is provided with a perforation surface pattern, and the other is a soft roll. The actual perforation may take place by blowing compressed air jets through the web while the web is supported against the wire or roll.

The perforation described above can also be utilised also to increase the efficiency of conventional pulp web air drying in cases where effective contact is required between the drying air and the pulp, for example, in conventional horizontal or vertical drying of chemical pulp.

BRIEF DESCRIPTION OF THE DRAWINGS

The invention is described in greater detail in the following, with reference to the appended drawings in which.

DETAILED DESCRIPTION OF THE DRAWINGS

Figure 1:
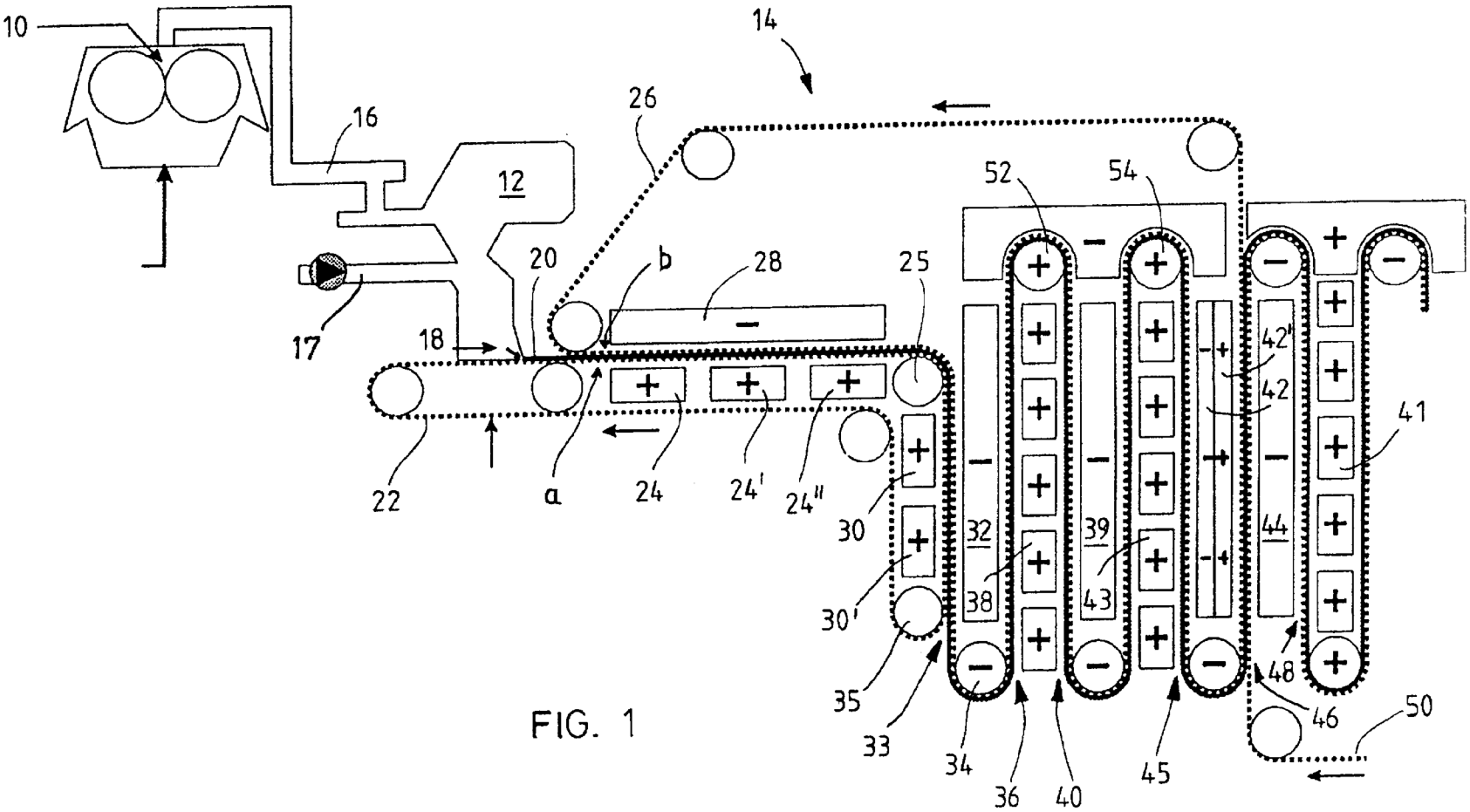
FIG. 1 shows diagrammatically a longitudinal cross-section of the first pulp drying line provided with a dryer section relating to the invention.

FIG. 1 shows a pulp drying line which comprises a pulp press 10, a pulp defibrator 12 and the actual dryer section 14. On the pulp press 10 the pulp is pressed from a dry matter content of about 2–3% to a dry matter content of about 30–50% and conveyed on the screw conveyor 16 to the defibrator 12.

The pulp press 10 comprises a press roll in the nip between the two rolls of which water is pressed out from the wet pulp. A screw press, for example, could also be used as a pulp press, in which case the pre-dried pulp could be taken directly to the defibrator 16 on the same screw press. In the solution shown in the figure it is essential that the pulp is pre-dried without forming the pulp into an actual web, which is difficult to shred or defibrate. Pulp pre-dried by a pulp press in accordance with the invention is easily defibrated into loose flakes, fibres or the like.

The pulp is defibrated into loose form in the defibrator, after which the loose pulp is spread by means of the air flow created by the blowing means 17 into an even air-permeable layer—the pulp web 20—on the horizontal web forming wire 22 at the beginning of the dryer section 14. The air flow is arranged to convey the pulp flakes or fibres evenly across the total width of the web. Air passes through the wire acting as a forming base, leaving the pulp flakes or fibres as an even layer on the wire. From the defibrator preferably loose pulp is fed to the wire, the dry matter content of the pulp being about 40–60%, typically >50%. The pulp web 20 is passed via the lip 18, supported by the wire 22, over the blow boxes 24, 24', 24" fitted inside the wire loop. Hot drying air or other drying gas is blown from the blow boxes through the wire 22 and the pulp web 20. In the embodiment of the invention shown in FIG. 1, an upper wire 26 is fitted to run above the pulp web 20. Inside this upper wire loop, mainly directly above the blow boxes 24, 24', 24", is fitted a suction box 28. This means that the hot air blown from the blow boxes 24, 24', 24", the drying air, flows through the lower wire 22, the web 20 and the upper wire 26 into the suction box 28. From the suction box the air is taken as exhaust air to a heater (not shown) for heating and for returning to the blow boxes 24, 24', 24". The length, of the horizontal travel of the pulp web depends mainly on the strength of the pulp web being formed. In some cases a horizontal section may not be required at all, but the pulp can be fed directly into the gap between two inclined or vertical wires.

The lower wire 22, the pulp web 20 and the upper wire 26 are guided by means of a turning roll 25 to turn directly downwards after the horizontal section, into the first drying gap 33 formed between the blow boxes 30, 30' and the suction box 32. In this first drying gap the pulp web is usually still in such loose form that it has to be supported on both sides by wires 22, 26.

By means of the overpressure in the blow boxes and the underpressure in the suction boxes, a pressure difference, preferably a pressure difference of about 200–800 Pa, is arranged across the pulp web running in the drying gap, by means of which the drying air is blown through the pulp web.

Even with relatively small pressure differences, of less than 500 Pa, many times higher evaporation rates per square metre are achieved in comparison to cylinder drying and conventional fan drying.

In the lower part of the first drying gap the pulp web 20 is detached from the wire 22, which is passed over the turning roll 35 back to the beginning of the dryer section. The pulp web is moved forward after the turning roll 35 only supported by the other wire 26. In the solution shown by way of an example in FIG. 1, the distance travelled by the pulp web between two wires is shown to be relatively short. The pulp web may, and often has to be, conveyed between two wires over a longer distance.

The turning roll 34 following the first vertical gap 33 guides the pulp web 20, supported by the upper wire 26, into the next vertical drying gap 36, which is formed between one side of the suction box 32 and the blow boxes 38 fitted on top of one another. The blow boxes 38 are fitted to blow drying air mainly perpendicularly to the pulp web running in the gap 36. From the suction box 32 the air; which has cooled down and become wet while passing through the pulp web, is taken as exhaust air for heating (which is not shown here) and again into the blow boxes 38 for circulation.

In the upper part of the drying gap 36 the pulp web 20 and the wire 26 supporting it are turned on the turning roll again, to run downwards, now through the third drying gap 40 on the other side of the blow boxes 38. In the dryer section the pulp web 20 and the wire 26 are thus guided to run forward in a wave-like fashion through the successive drying gaps, alternately upwards and downwards.

In the case shown in FIG. 1, in the first five drying gaps the drying air blasts are directed towards that side a of the pulp web which was turned downwards on the horizontal section. In order to direct the blasts to the other side of the pulp web, the pulp web has to be "turned". This is done by passing the pulp web from the gap 45 between the blow boxes 43, in which air is blown on side a of the web, and the suction box 42 into the gap 46, in which the pulp web runs between the blow box 42' connected immediately after the above-mentioned suction box 42 and the suction box 44. Between the successive gaps 45 and 46 there is, therefore, in this case a double-acting box, one side 42 of which acts as a suction box and the other side 42' as a blow box from which air is blown onto side b of the pulp web. The double-acting box 42/42' acts in such a way as to change the direction of drying.

The pulp web may obviously also be thought to be turned by taking it through the gap which is delimited on both sides by the blow boxes.

When, in the case of FIG. 1, the direction of the air blown through the pulp web changes, the supporting of the pulp web changes over to the other side of the web, that is, to the suction boxes' side. Had the pulp web been supported by two wires up to this point, and if the intention was to continue supporting it on two wires, the corresponding change would obviously not be required. However, should the intention be to change to single-wire transfer after twin-wire transfer, the wire on the side of the blow boxes can be detached from the web. In the case of FIG. 1, the transfer of the web support from one side to the other takes place in such a way that during the exchange, the pulp web is supported temporarily in the gap 46 by two wires 26 and 50, after which the old wire 26 is detached from the pulp web 20 and the web continues its travel to the next drying gap 48 between the boxes 44 and 41, supported by a new wire 50.

FIG. 1 shows only eight vertical drying gaps. In a solution relating to the invention there is, however, usually a much larger number of gaps, e.g. 20–30. In this way the web can, for example, be passed through >10 gaps supported by two wires at the beginning of the dryer section, and also through >10 gaps at the end of the dryer section, supported only by a single wire. The web is usually passed through several of the first gaps supported by two wires, although this has not been shown in the case of FIG. 1.

To improve the efficiency of drying, a suction box may be situated above the turning rolls 52, 54 provided with blowing, as shown in FIG. 1, to remove wet and cooled air from this area. The dryer section is typically covered by a hood, although this is not shown in FIG. 1.

Figure 2:
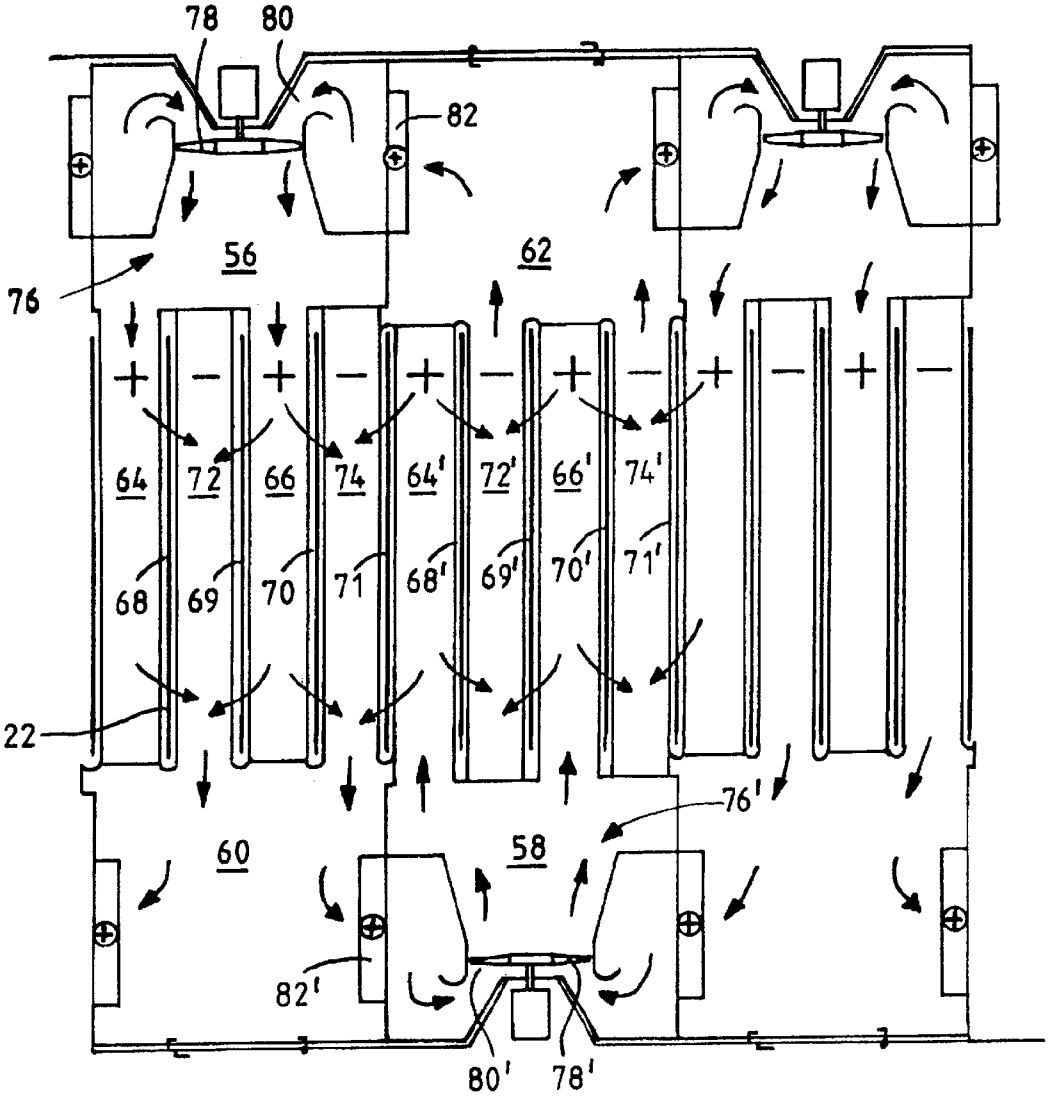
FIG. 2 shows diagrammatically a horizontal section of the dryer section shown in FIG. 1, which has local exhaust air circulation between the suction box and the blow box.

FIG. 2 shows a horizontal section of a part of a dryer section 14 similar to that shown in FIG. 1, on either side of which are fitted alternately, in succession, vertical pressure chambers 56, 58 of a height corresponding mainly to the dryer section, and vertical vacuum chambers 60, 62 of a height corresponding mainly to the dryer section. The pressure chambers and vacuum chambers may be integral chambers of a height corresponding mainly to the dryer section, or combinations of chambers formed of separate chamber blocks on top of one another.

In the case shown in FIG. 2, drying air is fed from both pressure chambers 56, 58 to the blow boxes 64, 66, 64', 66' of the two successive rows of blow boxes formed by blow boxes placed on top of one another. From the blow boxes the drying air is blown through the pulp web 20 running in the drying gaps 68, 69, 70, 71, 68', 69', 70', 71', in order to dry the web, into the adjacent suction boxes 72, 74, 72', 74'. From the suction boxes the air is recirculated as return air to the vacuum chamber 60, 62 on the other side of the. dryer section, as seen from the pressure chamber.

Overpressure is created in the pressure chamber 56, 58 and underpressure in the vacuum chamber 62, 60 adjacent to it by means of a fan 78, 78' mounted on a fan tower 76, 76' fitted adjacent to the pressure chamber, the said fan blowing air from the vacuum chamber 62, 60 to the pressure chamber 56, 58. Between the vacuum chamber and the fan inlet 80, 80' a heater 82, 82' is mounted, by means of which the air blown is heated to the desired temperature. On the fan towers 76, 76' there may preferably be mounted several fans 78, 78' on top of one another, usually at least three, typically 4–7 fans, depending on the height of the dryer section.

The air may be heated in the heater 82, 82' by means of steam, e.g. to a temperature of about 120–170° C. If heating is carried out by gas combustion, the drying air can be heated to higher temperatures, e.g. to a temperature of about 200° C. During twin-wire transfer, the heat resistance of the wire prevents the use of excessively hot drying air. When the pulp web is only supported on the suction box side, higher temperatures may also be used than in cases where the web is supported on both sides.

The blow or suction boxes used in the solution shown in FIGS. 1 and 2 typically comprise a narrow box-like structure, on one side of which are formed blow nozzles or suction inlets. The blow nozzles may be perforated nozzles in which the diameter of the holes is, for example, within the range of 4–10 mm. The total surface area of the perforations of the surface area of the nozzle surface is typically 0.5–3%. The diameter of the suction inlets is typically considerably greater than that of the blow nozzles.

On the horizontal web section, the blow or suction box is fitted above or below the web, with the surface provided with blow nozzles or suction inlets turned towards the web. Similarly, the blow or suction box is fitted adjacent to the web running vertically, with the surface provided with blow nozzles or suction inlets turned towards the web. When the blow or suction box is fitted between two web runs, that is, two drying gaps, the two opposite ends of the box which are directed towards the webs may be provided with blow nozzles or suction inlets, which means that the box is able to blow air into the area of both web runs or remove air from the area of both web runs. On the other hand, two conventional blow or suction boxes can obviously also be fitted adjacent to each other between the webs, the first box with the surface provided with nozzles or inlets turned towards the first web run, and the second box with the surface provided with nozzles or inlets turned towards the second web run. The box 42, 42' in FIG. 1 shows this type of combination of a blow and suction box.

In cross-web direction, the blow and suction boxes are mainly of a length corresponding to the width of the web, that is, extend mainly from one (tending) side of the dryer section to its other (driving) side and/or vice versa. The drying gap itself extends through the dryer section from its tending side to its driving side. The boxes may be of various heights. As shown in FIG. 1, a suction box may be may so high in the vertical direction that it will extend from the lower part of the drying gap to its upper part, in which case only one suction box is required per gap. Both the blow and suction boxes may be of modular construction or single chambers as high as the entire gap. The height of a drying gap is preferably about 6–12 m.

In the dryer section solution relating to FIGS. 1 and 2, the removal of broke in connection with a possible break is particularly easy on the first part of the dryer section, where the web 20 is supported from above by means of the wire 26. A broke conveyor, onto which the broke falls freely, may be fitted below the dryer section. In the last part of the dryer section the pulp web is already much drier and a break will not, therefore, cause as many problems as with a wet web.

On the other hand, in the last part of the dryer section the pulp web can often already be moved supported only by one wire, which means that the broke can fall freely down onto the broke conveyor also from this part.

Figure 3:
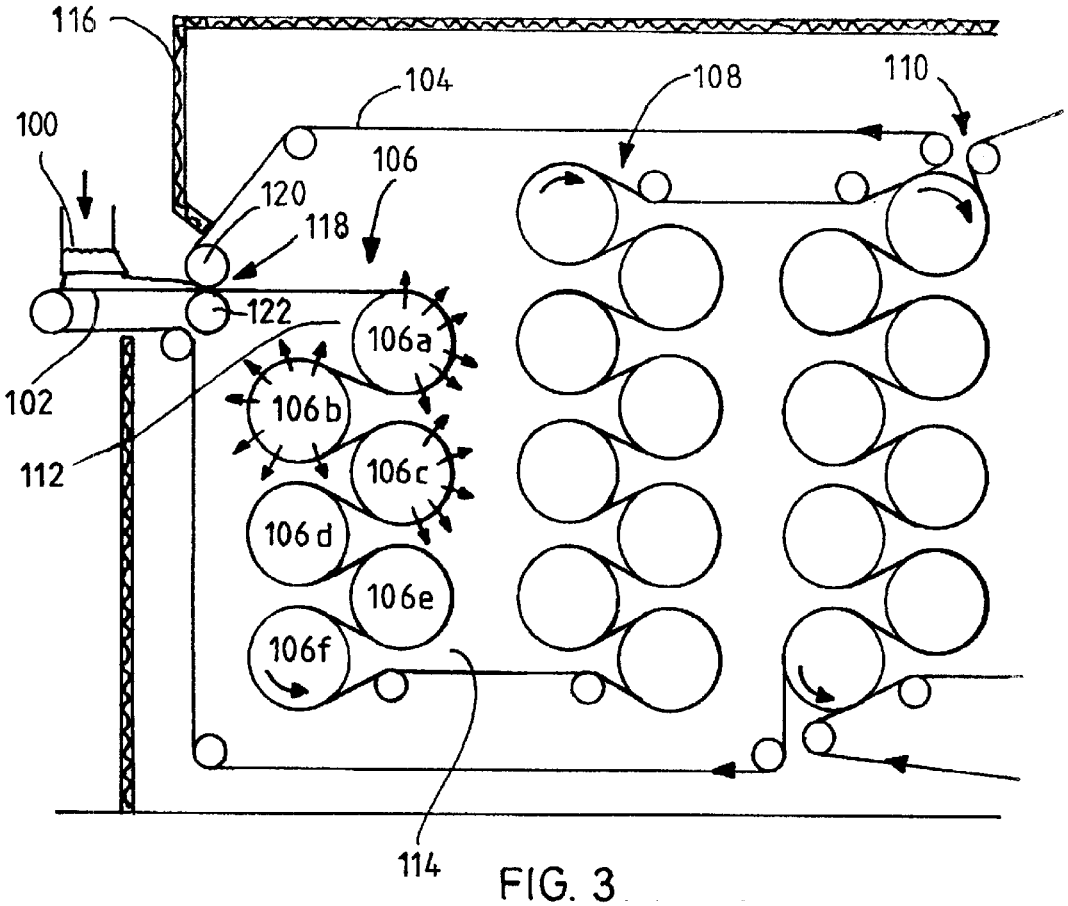
FIG. 3 shows diagrammatically a longitudinal cross-section of a second dryer section relating to the invention.

FIG. 3 shows a second solution relating to the invention in which the pulp web is guided over drying drums, from which drying air is blown through the web as it passes over the drying drums.

In the solution shown in FIG. 3, loose pulp is fed from the defibrator 100 to the wire 102 which forms the forming base from where the pulp web thus formed is taken between the two wires 102 and 104 over the drying drums 106*a,* 106*b,* 106*c,* 106*d,* 106*e* and 106*f* stacked on top of one another in the first group of drying drums 106 as a downward run. After this the pulp web is passed further through the next drying drum groups 108 and 110, first as an upward run and then as a downward run.

The web runs in each drying drum group between the wires 102, 104 from one drying drum to another, so that every other drum 106*a,* 106*c,* 106*e* is on the first side 112 of the web and every other drum 106*b,* 106*d,* 106*f* on the other side 114 of the web. In this way, the drying air blown from the drums meets alternately the first and then the second side of the web to be dried, which means that the web dries evenly on both sides.

The dryer section provided with drying drums is covered with a hood 116, which means that the air blown through the web may be released freely into the hood space. Recirculated air may be collected from the hood space for heating and to be returned to the drying drums as drying air.

If so desired, some of the drying drums can be provided with means effecting suction instead of blowing. In the last part of the dryer section it is possible to mount drums blowing cooling air instead of drums blowing drying air.

Figure 4:
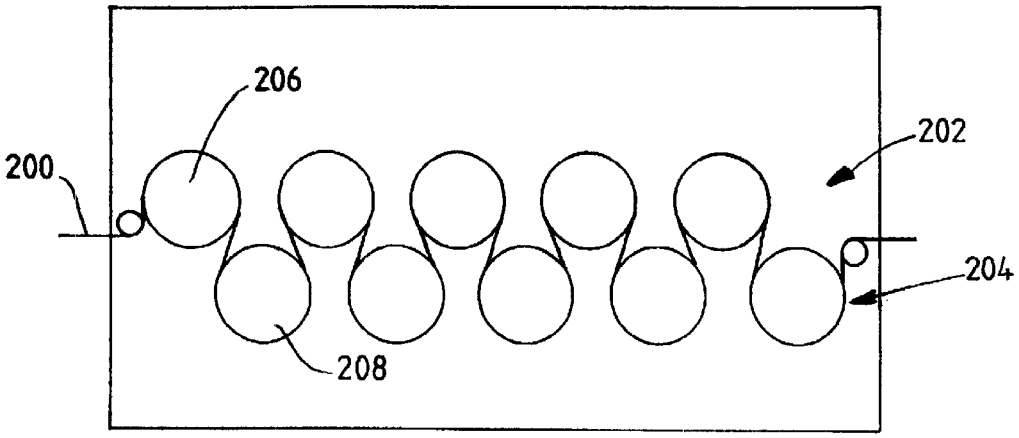
FIG. 4 shows diagrammatically a longitudinal cross-section of a third dryer section relating to the invention.

FIG. 4 shows a third solution relating to the invention, in which the drying drums mainly conforming to those shown in FIG. 3 are fitted in succession, and in which the pulp web can be passed over the cylinders while supported by one or two wires.

In the case of FIG. 4, the web 200 to be dried is passed over rotating through-blowing drums 206 fitted in two rows, a top row 202 and a bottom row 204. The pulp web is arranged to run while supported by one or two wires in a manner known as such. The web may be conveyed between two wires over the drums 206 of the top wire and the drums 208 of the bottom wire. The drums in both rows may be provided with means for blowing drying air through the drum shell, towards the pulp web passing over the shell.

When the pulp web is sufficiently durable, it may be passed over the drums blowing drying air supported only by the wire running above the web. This means that the web may correspondingly be passed over drums provided with suction supported only by a wire running below the web.

Figure 5:
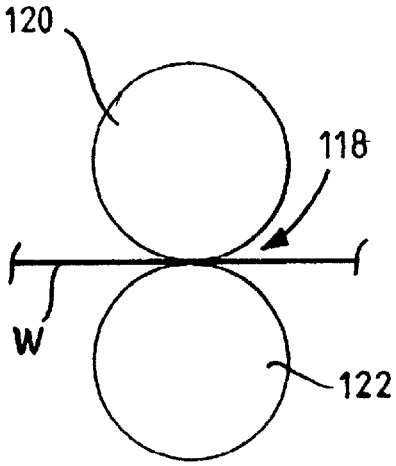
FIG. 5 shows diagrammatically a cross-section of the roll nip perforating the pulp web.
Figure 6:
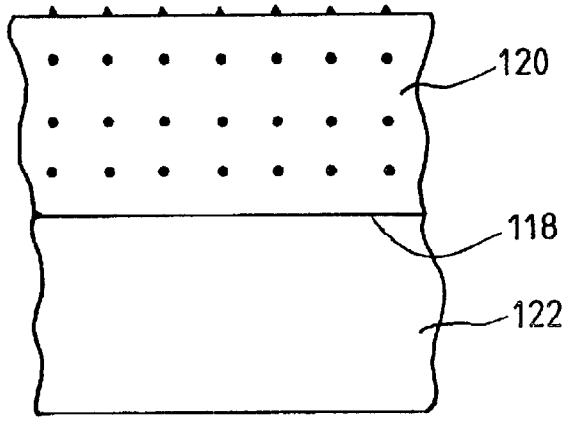
FIG. 6 shows a part of the rolls shown in FIG. 5, as seen from the side.

As shown in FIGS. 5 and 6, the perforation of the web can be carried out before drying, for example, at the nip preceding the dryer section, such as the nip 118 shown in FIG. 3, in which one of the rolls 120 forming the nip has a surface pattern which makes the perforations and the other roll 122 is a backing roll with a soft surface.

Figure 7:
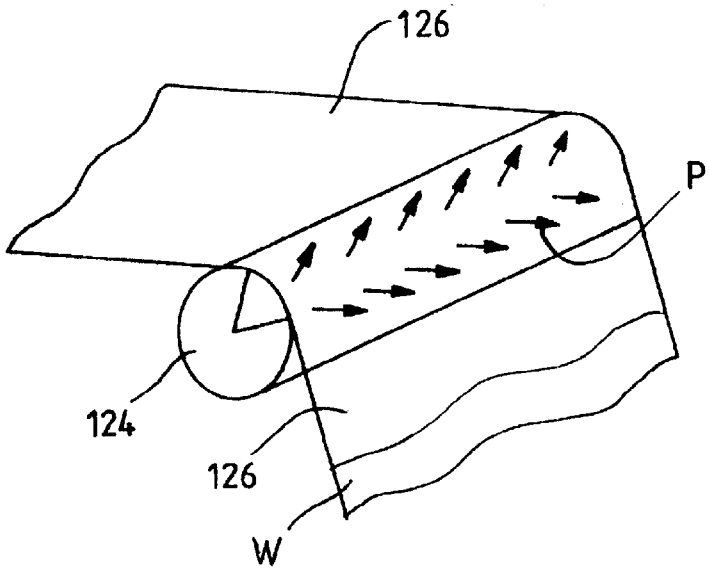
FIG. 7 shows diagrammatically another arrangement for perforating the pulp web.

As shown in FIG. 7, the perforation can also be done using compressed air, in which case the web is passed over a perforating roll 124, on which holes are blasted over a small sector of the web W, using compressed air P, through the roll 124, in accordance with the perforation pattern of the roll. In this case the web is supported on one side e.g. by means of wire 126 or a backing roll.

By means of the solution relating to the invention, in which pre-drying takes place without web formation, by combined cylinder drying and fan drying, the following advantages are achieved in comparison with the known solution:

- the pulp is formed into a web only once, that is, in connection with fan drying, in other words a web does not have to be formed for the purpose of pre-drying;
- no conventional cylinder group is required in the pre-drying line, which thus means savings in space and construction costs;
- space can be saved by arranging local air circulations in the actual dryer section, which makes it possible to adjust drying locally;
- the vertical travel of the web takes up little space;
- the already dried air-permeable pulp web can easily be broken up again for paper manufacture;
- the web does not necessarily have to be supported on both sides, and
- drying is efficient, uniform and easily adjustable.

The aim is not to limit the invention to the embodiments presented above by way of examples, but on the contrary the aim is to apply it extensively within the scope of protection determined in the claims below.

What is claimed is:

1. A line for drying wet pulp comprising:

a pulp press which presses wet pulp to pre-dry the wet pulp to a dry matter content of about 30–50%;

a plurality of defibrators for defibrating pre-dried pulp from said pulp press, said plurality of defibrators connected in succession in a dimension substantially transverse to the direction of movement of the web to be formed, and spreading loose pulp in an area covering the total width of the web;

wet pulp transfer means for transferring pulp from said pulp press to said defibrator;

a web forming section for forming an air-permeable web from loose pulp from said defibrator, said web forming section comprising a forward-moving air-permeable forming base, and a device which spreads loose pulp on said moving forming base;

defibrated pulp transfer means for transferring defibrated pulp from said defibrator to said web forming section; and a dryer section operatively connected to said web forming section to receive an air-permeable web from said web forming section, said dryer section comprising a forward moving air-permeable support fabric which is fitted to support the pulp web, and at least one blower which blows drying air or gas through the pulp web.

2. A drying line as set forth in claim 1 wherein said pulp press and wet pulp transfer means comprises a screw press or screw conveyor.

3. A drying line as set forth in claim 1 wherein said pulp press comprises a roll press having a nip formed by rotating rolls.

4. A drying line as recited in claim 1 wherein said defibrators comprise a fine shredder having a width substantially equal to the width of said web forming base, for breaking up pulp into flakes.

5. A drying line as recited in claim 1 wherein said web forming section comprises air-blowing means for carrying loose pulp in air flow and spreading the loose pulp evenly over said air-permeable forming base.

6. A drying line as recited in claim 5 further comprising means for controlling the temperature of the air used in said air blowing means in said web forming section so that it is greater than 100° C. but less than 300° C.

7. A drying line as recited in claim 5 wherein said air blowing means in said web forming section blows air over the total width of the web to be formed.

8. A drying line as recited in claim 1 further comprising a first wire loop and a second wire loop, said first and second wire loops having a path partly in common in at least one of said web forming section and said dryer section.

9. A drying line as recited in claim 1 wherein said device which spreads loose pulp on said moving forming base comprises a device fitted in front of a closing gap between said first and second live wires.

10. A drying line as recited in claim 8 wherein said common path portion of said first and second wires is provided in both said web forming section and said dryer section, and is substantially horizontal in said web forming section and is at least partially vertical, running upwardly and downwardly, in said dryer section.

11. A drying line as recited in claim 8 wherein said dryer section comprises a plurality of drying drums positioned one on top of the other, or in series, each drum having an air permeable outermost shell, and including means for blowing hot air through the pulp web passing over said drums or for sucking wet air into said drums through the pulp web passing over said drums.

12. A drying line as recited in claim 8 wherein said dryer section comprises a plurality of drying drums fitted one on top of the other, or in series, each drum having an air permeable outer shell, and means for blowing hot air through the pulp web passing over said drums; and wherein said common path of wires is provided in said dryer section so that said wires run over said drying drums alternately with the wire of the first wire loop in contact with a said drum, and with the wire of the second wire loop in contact with a said drum.

13. A drying line as recited in claim 1 wherein in said dryer section said at least one blower is constructed to blow air toward a first side of the web in a first part of the dryer section, and to blow air towards a second side of the web, opposite the first side, in a second part of said dryer section.

14. A drying line as recited in claim 13 wherein said first part of said dryer section comprises suction boxes for removing wet drying air from said second side, and said second part of said dryer section comprises suction boxes for removing wet drying air from said first side of the web.

15. A drying line as recited in claim 8 wherein a first part of said first wire forms a horizontal air permeable forming base in said web forming section, and a second part of said first wire a vertical air permeable support fabric in said dryer section; and said second wire is positioned to run above said first wire over a part of its horizontal run in said web forming section so that a gap of the thickness of the pulp web is formed between said first and second wires.

16. A drying line as recited in claim 8 further comprising a first part of said first wire forming a horizontal air-permeable forming base in said web forming section, and a second part of said first wire a vertical air-permeable support fabric in said dryer section which supports the web on a first side thereof; and said second wire runs in said dryer section on a second side of said web, opposite said first side, parallel with and close to said first wire over a part of its vertical wire run, so that said second wire supports the pulp web on its second side.

17. A line for drying wet pulp comprising:

a pulp press which presses wet pulp to pre-dry the wet pulp to a dry matter content of about 30–50%;

a defibrator for defibrating pre-dried pulp from said pulp press;

wet pulp transfer means for transferring pulp from said pulp press to said defibrator;

a web forming section for forming an air-permeable web from loose pulp from said defibrator, said web forming section comprising a forward-moving air-permeable forming base, and a device which spreads loose pulp on said moving forming base;

defibrated pulp transfer means for transferring defibrated pulp from said defibrator to said web forming section; and a dryer section operatively connected to said web forming section to receive an air-permeable web from said web forming section, said dryer section comprising a forward moving air-permeable support fabric which is fitted to support the pulp web, and at least one blower which blows drying air or gas through the pulp web, wherein said dryer section comprises: a plurality of blow boxes for blowing drying air through the pulp web as it runs in said dryer section; a plurality of suction boxes for removing drying air blown through said pulp web; heating means for heating air removed by the suction boxes; and means for circulating the heated air as drying air to said blow boxes; and wherein a first part of said blow boxes, and a first part of said suction boxes, are positioned in said dryer section so that they form between them at least one first narrow vertical drying gap extending through said dryer section in a dimension substantially perpendicular to the dimension of movement of the web; at least a second part of said blow boxes and at least a second part of said suction boxes positioned in said dryer section so that they form at least one second narrow vertical drying gap extending through said dryer section in a dimension substantially perpendicular to the web direction of movement; and support means which convey a pulp web through said dryer section supported by a first wire at least through said vertical drying gap.

18. A drying line as recited in claim 17 wherein said dryer section further comprises means supporting said first wire to run in a horizontal plane to form said air-permeable forming base before said first vertical drying gap; means for positioning a second wire to run above the pulp web onto said first wire; and turning means for turning the paths of said first and second wires so as to be vertical.

19. A drying line as recited in claim 17 wherein said first part of said dryer section comprises at least ten vertical drying gaps through which the pulp web to be dried is passed supported by two wires.

20. A drying line as recited in claim 17 wherein said dryer section comprises a last part including at least ten vertical drying gaps through which the pulp web to be dried is passed supported by a single wire.

21. A drying line as recited in claim 17 further comprising a first part of said blow boxes of said dryer section positioned to blow drying air on the first side of the pulp web, and a second part of said blow boxes positioned to blow drying air onto the second side of the pulp web, opposite the first side.

22. A drying line as recited in claim 17 further comprising a first wire running in a horizontal plane in a first part of the dryer section, at least one of said blow boxes positioned below said first wire running in said horizontal plane in said first part of said dryer section; and a second wire running in a horizontal plane in said first part of said dryer section, at least one suction box positioned above said second wire.

23. A drying line as recited in claim 17 wherein said dryer section further comprises a first blow box for blowing drying air through said pulp web toward a first suction box, and a second blow box for blowing drying air through the pulp web towards a second suction box; first heating means for heating a first exhaust air flow coming from said first suction box, and second heating means for heating a second exhaust air flow coming from said second suction box; and a first fan for feeding the heated first exhaust air flow as drying air to said second blow box, and a second fan for feeding the heated second exhaust air flow as drying air to said first blow box.

24. A method of drying wet pulp with a dry matter content of less than 3% comprising:

a) pre-drying the wet pulp having a dry matter content of less than 3% so as to have a dry matter content of about 30–50% by pressing the pulp to remove liquid therefrom;

b) defibrating the pre-dried pulp from a) to form a loose pulp suitable for web formation with a plurality of defibrators connected in succession in a dimension substantially transverse to the direction of movement of the web to be formed;

c) spreading the loose pulp from b) on an air-permeable forming base in an area covering the total width of the web to produce a pulp web of desired width and thickness; and d) drying the web to a dry matter content of greater than 50% by blowing drying air or gas through the web while it is moving supported by an air-permeable supporting fabric.

25. A method as recited in claim 24 further comprising removing drying air gas blown through the web in d) as exhaust air gas, heating the exhaust air gas, and returning the heated exhaust air as drying air in d); and further comprising practicing d) so that the pulp web moves upwardly and downwardly in said dryer section.

26. A method as recited in claim 25 wherein d) is practiced to blow air through said web from a first face thereof through a second face thereof, and also from the second face thereof through the first face thereof; and wherein the air blown through both of said first and second faces is heated and recirculated for drying air in the practice of d).

27. A method as recited in claim 24 wherein a)–c) are practiced so that the loose pulp fed to d) has a dry matter content of between 40–60%, and wherein d) is practiced so that the dry matter content is greater than 60%.

28. A method as recited in claim 24 wherein d) is practiced to cause the pulp to move between two wires and into operative contact with at least two drying drums with alternately a first side and then a second side of the web turned toward the surface of a drum; and by blowing hot drying air from the circumference of the drying drums through the pulp web running over said drums.

29. A method as recited in claim 24 wherein a) is practiced so as to pre-dry the wet pulp to have a dry matter content of about 40–50%.

30. A method as recited in claim 28 further comprising sucking wet air into at least some of said drying drums through the pulp web running over said drums.

* * * * *

UNITED STATES PATENT AND TRADEMARK OFFICE

CERTIFICATE OF CORRECTION

PATENT NO. : 6,372,094 B1
DATED : April 16, 2002
INVENTOR(S) : Heikkila et al.

It is certified that error appears in the above-identified patent and that said Letters Patent is hereby corrected as shown below:

Title page,
Item [30], please delete

"[30] Foreign Application Priority Data
Apr. 28, 1999 [FI] ……...980928" and insert therefor -- [30] Foreign Application Priority Data
Apr. 28, 1998 [FI] ……...980928 --.

Signed and Sealed this

Fourteenth Day of January, 2003

JAMES E. ROGAN
*Director of the United States Patent and Trademark Office*